US012054927B2

(12) United States Patent
Miller et al.

(10) Patent No.: US 12,054,927 B2
(45) Date of Patent: Aug. 6, 2024

(54) FIRECLAY APRON-FRONT SINK WITH INTERGRATED LEDGE AND SELF-TRIMMING FEATURES

(71) Applicant: Kohler Co., Kohler, WI (US)

(72) Inventors: Jason R Miller, Sheboygan Falls, WI (US); Paul A. Bonack, Kohler, WI (US)

(73) Assignee: Kohler Co., Kohler, WI (US)

( * ) Notice: Subject to any disclaimer, the term of this patent is extended or adjusted under 35 U.S.C. 154(b) by 219 days.

(21) Appl. No.: 17/236,799

(22) Filed: Apr. 21, 2021

(65) Prior Publication Data

US 2021/0332578 A1 Oct. 28, 2021

Related U.S. Application Data

(60) Provisional application No. 63/015,174, filed on Apr. 24, 2020.

(51) Int. Cl.
*E03C 1/33* (2006.01)
*E03C 1/18* (2006.01)

(52) U.S. Cl.
CPC . *E03C 1/33* (2013.01); *E03C 1/18* (2013.01)

(58) Field of Classification Search
CPC ..... E03C 1/33; E03C 1/18
USPC ..... D23/284
See application file for complete search history.

(56) References Cited

U.S. PATENT DOCUMENTS 2,127,559 A 8/1938 Graf
5,016,297 A 5/1991 Sauter et al.
5,644,943 A 7/1997 Lanz
5,797,150 A 8/1998 Lanz
D494,665 S * 8/2004 Herbeau ..... D23/293.1
7,854,030 B2 12/2010 Lee et al.
D700,301 S * 2/2014 Rachiele ..... D23/284
8,844,070 B2 9/2014 Booth et al.
(Continued)

FOREIGN PATENT DOCUMENTS

CA 2203227 C 6/2005
CA 2639213 8/2008
(Continued)

OTHER PUBLICATIONS

Extended European Search Report on EP Appl. Ser. No. 21170113.1 dated Sep. 28, 2021 (13 pages).
(Continued)

*Primary Examiner* — Christine J Skubinna
(74) *Attorney, Agent, or Firm* — Husch Blackwell LLP

(57) ABSTRACT

An undermount, apron-front sink is provided. The sink includes a basin, a ledge, a rim coupled with the basin, an upper portion, and an apron. The basin includes a first side wall, an opposite second side wall, a front wall, and a rear wall. The ledge is supported at and extends outwardly from an upper end of one of the front wall and the rear wall of the basin. The rim is supported at and extends outwardly from the basin in a substantially horizontal orientation to form a continuous planar surface that is configured to be mounted abutting an underside of a horizontal countertop. The upper portion extends between the ledge and the one of the front wall and the rear wall. The apron is coupled with the basin and includes a right end portion, a left end portion, a front face, and a rear face.

19 Claims, 12 Drawing Sheets

(56) References Cited

U.S. PATENT DOCUMENTS

| | | | | |
|---|---|---|---|---|
| 9,173,487 | B2 | 11/2015 | Booth et al. | |
| 9,492,011 | B2 | 11/2016 | Booth et al. | |
| 9,574,333 | B2 * | 2/2017 | O'Brien | A47J 47/005 |
| 10,125,481 | B2 | 11/2018 | Booth et al. | |
| D845,451 | S * | 4/2019 | Swilley | D23/308 |
| 10,687,620 | B2 | 6/2020 | Booth et al. | |
| 10,704,241 | B2 | 7/2020 | Miller | |
| 11,523,685 | B2 * | 12/2022 | Kilgallon | A47B 13/003 |
| 2018/0187403 | A1 * | 7/2018 | Chong | E03C 1/18 |
| 2019/0191874 | A1 * | 6/2019 | Booth | A47B 77/022 |
| 2020/0063412 | A1 * | 2/2020 | Miller | A47B 96/20 |
| 2020/0102726 | A1 * | 4/2020 | Miller | E03C 1/33 |
| 2020/0268150 | A1 | 8/2020 | Booth et al. | |

FOREIGN PATENT DOCUMENTS

| | | | |
|---|---|---|---|
| CN | 106894476 | | 6/2017 |
| EP | 2 681 367 | A1 | 1/2014 |
| WO | WO-2012/121976 | A1 | 9/2012 |

OTHER PUBLICATIONS

China Office Action, with English Summary, corresponding 202110445946.9 dated May 31, 2023.

* cited by examiner

FIRECLAY APRON-FRONT SINK WITH INTERGRATED LEDGE AND SELF-TRIMMING FEATURES

CROSS-REFERENCE TO RELATED PATENT APPLICATION

This application claims the benefit of and priority to U.S. Provisional Application No. 63/015,174, filed on Apr. 24, 2020, the entire disclosure of which is incorporated by reference herein.

BACKGROUND

The present disclosure relates generally to the field of sinks. More specifically, the present disclosure relates to the field of apron-front sinks.

Sinks are vessels generally configured for receiving water. Usually, a faucet or other water source is located proximate to the sink, and a drain pipe is coupled to the sink to remove unwanted water. A sink is often mounted on or into a cabinet, stand, or pedestal. A sink may be mounted such that a rim of the sink rests on a countertop of a cabinet. This is generally referred to as self-rimming. Alternatively, a sink may be mounted such that the rim of the sink is located below the countertop. This is generally referred to as under-counter mounted or under-mounted. Apron-front sinks, which include farmhouse sinks, have an exposed panel extending laterally across a front portion of the sink forward of the basin. One continuing challenge in the field of apron-front sinks relates to fitting the sink into the cabinet. Installation of an apron-front sink usually requires precise and repeated cuts to fit the sink to the front of the cabinet without leaving unsightly gaps between the apron and the cabinet. This custom fitting method takes time and requires an installer to repeatedly lift a heavy sink to check for fit.

Another continuing challenge in the field of apron-front sinks relates to compatibility with sink accessories, such as cutting boards, drying racks, and the like.

Another continuing challenge in the field of apron-front sinks relates to retrofitting. Usually apron-front sinks will not fit into standard, stock, or off-the-shelf non-apron-front cabinetry due to the width of the sink and the height of the cabinet's lower doors. Alternatively, such retrofits require extensive modifications to the cabinet or installation of an undersized sink.

SUMMARY

At least one embodiment relates to an undermount, apron-front sink. The sink includes a basin, a ledge, a rim coupled with the basin, an upper portion, and an apron. The basin includes a first side wall, an opposite second side wall, a front wall, and a rear wall. The ledge is supported at and extends outwardly from an upper end of one of the front wall and the rear wall of the basin. The rim is supported at and extends outwardly from the basin in a substantially horizontal orientation to form a continuous planar surface that is configured to be mounted adjacent an underside of a horizontal countertop. The upper portion extends between the ledge and the rim. The apron is coupled with the basin and includes a right end portion, a left end portion, a front face, and a rear face. The right end portion extends rightward of the rim and a left end portion extends leftward of the rim such that the apron is wider than the basin. The front face extends vertically below the rim and the rear face is opposite to the front face. The rear face is configured to engage a vertical surface of a cabinet when the rim is mounted abutting the horizontal countertop.

Another embodiment relates to an undermount, apron front sink. The sink includes a basin having a first side wall, an opposite second side wall, a front wall, and a rear wall. A first ledge is supported at and extends outwardly from an upper end of the front wall of the basin. A second ledge similar to the first ledge is supported at and extends outwardly from an upper end of the rear wall of the basin. The basin further includes a rim offset from the first ledge and the second ledge that extends outwardly from the basin in a substantially horizontal orientation to form a continuous planar surface configured to be mounted abutting an underside of a horizontal countertop. A first upper portion extends between the rim and the first ledge and extends in a direction substantially parallel to the front wall. Similarly, a second upper portion extends between the rim and the second ledge in a direction substantially parallel to the rear wall. The sink further includes an apron coupled with the basin, the apron including a portion of the rim.

Another embodiment relates to an undermount, apron-front sink. The sink includes a basin including at least one basin wall and a ledge supported at and extending outwardly from an upper end of the at least one basin wall. An apron is coupled with the basin and includes a top flange, a front face, a rear face, and a cavity positioned between the front face and the rear face. The sink further includes a rim coupling the apron to the at least one basin wall, the rim being continuous and coplanar with the top flange. An upper portion extends between the rim and the ledge and extends in a direction generally parallel to the at least one basin wall. The rim is configured to be mounted adjacent an underside of the horizontal countertop.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
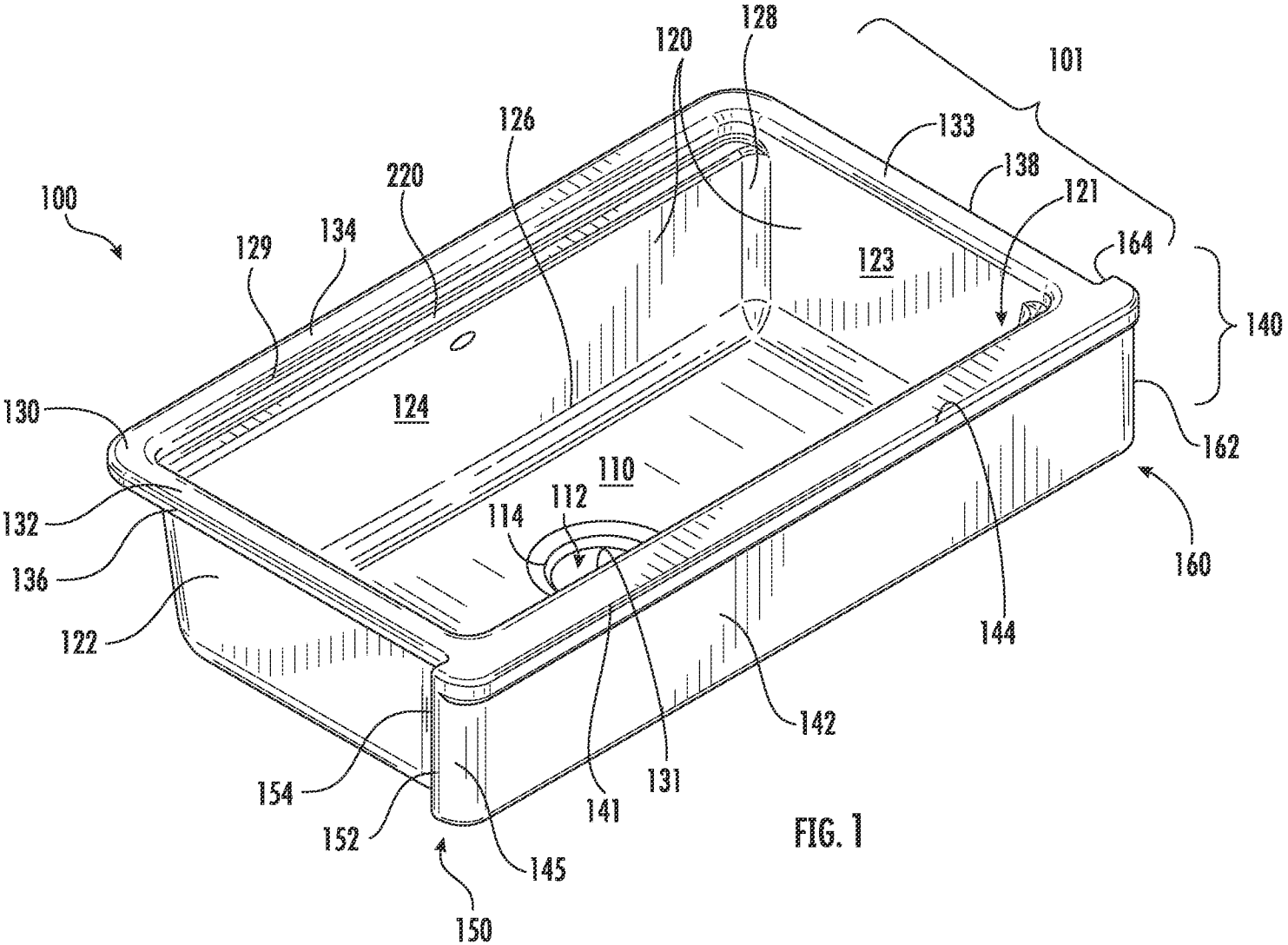
FIG. 1 is a perspective view of a sink, shown according to an example embodiment.

Before turning to the FIGURES, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, sinks and components thereof are shown according to various exemplary embodiments. The sinks may be installed in various environments including a kitchen or bathroom. The sinks are designed to replace and/or be installed in place of a conventional sink to provide a user with the appearance of a traditional apron front or farmhouse sink without requiring significant modifications to the cabinetry or other support structures that may otherwise be required for traditional apron front and farmhouse sinks.

The sinks generally include one or more basins and a front apron coupled to the one or more basins. The one or more basins are defined by a floor and one or more sidewalls extending upwardly from the floor. The sink may have any number of basins. For example, the sink may have one, two, or more basins. Alternatively, the sink may have a single basin divided into two or more reservoirs. The basins or reservoirs may be separated by one or more dividers (e.g., separator, structure, hump, ridge, etc.), such as a saddle. The saddle may be of any height, but preferably remains below the rim plane of the sink. The saddle may divide the sink into multiple equal or unequal sized basins or reservoirs.

The sinks also include a flange or rim outwardly extending from a top edge or portion of the sidewalls. The apron, which is coupled to or integrally formed with the front wall of the basin via the same or similar rim, extends downwardly from the rim and laterally between a first end and a second end to define a front portion of the sink. The first and second ends of the apron extend laterally beyond the outer periphery of the rim associated with each corresponding side wall. Extending the ends of the apron past the outer periphery of the rim may allow the ends of the apron to at least partially overlap a face of the cabinetry to conceal possible cut lines and/or openings in the face of the cabinetry.

The sinks also include one or more ledges positioned below the aforementioned flange or rim. The ledges may extend from a top edge or portion of the sidewalls, interposed between the aforementioned flange or rim and the sidewalls. The ledges can, advantageously, provide a supporting surface for supporting various sink accessories in the sink partially below the countertop in an undermount situation, such as cutting boards, drying racks, towel bars, and similar sink accessories. In some embodiments, sinks are top-mounted sinks and rest on a top surface of the countertop. In such embodiments, the ledges may be positioned below the counter top, or between the top surface and a bottom surface of the countertop. The one or more ledges may extend about a full or partial perimeter of the sidewalls. According to an exemplary embodiment, the sinks may include a first ledge and a second ledge extending along two opposite and parallel sidewalls, such as along the front and rear of the basin, where the first ledge and the second ledge are discrete from each other (e.g., not contiguous with each other). The ledges may define a supporting surface that is oriented at an angle, so as to direct water from the sink accessories, which are supported by the ledges, into the basin of the sink. According to an exemplary embodiment, the disclosed sinks including the front apron and ledges may be integrally formed from a fireclay material.

Before discussing further details of the sinks and/or the components thereof, it should be noted that references to "front," "back," "rear," "upper," "lower," "right," and "left" in this description are merely used to identify the various elements as they are oriented in the FIGURES, with "right," "left," "front," "back," and "rear" being relative to a user facing the sink, and with "lateral" being left-right as viewed by the user. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring to FIGS. 1-6, a sink 100 is shown according to an exemplary embodiment. Sink 100 includes at least one receptacle for receiving and/or holding water (e.g., a reservoir, washbasin, bowl, etc.), shown as a basin 101. Basin 101 may have a variety of shapes, for example, circular, oval, polygonal, or sections of the shapes thereof (e.g. circle sector).

According to the embodiment shown, basin 101 is substantially rectangular with a lateral width dimension (e.g., side-to-side) being greater than the depth dimension (e.g., front-to-back).

Basin 101 is shown as including a floor 110. Floor 110 may have a variety of shapes and textures. Floor 110 defines one or more apertures, shown as a drain 112, that allow water to be removed from basin 101. As shown, drain 112 is substantially circular and located in a middle portion of floor 110. According to the various alternative embodiments, drain 112 may be non-circular and may be located elsewhere in floor 110 (e.g., in a front portion, a left portion, a rear portion, a right portion, centrally, or some combination thereof, etc.). Drain 112 is shown as being defined by a lip 114. Drain 112 may be coupled to a drain pipe and/or a garbage disposal mechanism, which is in turn coupled to a municipal sewerage system or to a septic system. According to an exemplary embodiment, floor 110 is sloped towards drain 112 such that water in basin 101 flows toward drain 112 by gravitational force. According to the various alternative embodiments, the sidewalls of basin 101 may be continuously curved such that no discernable floor is formed.

Basin 101 is also shown as including a plurality of sidewalls (generically referred to together as sidewalls 120) which extend generally upwardly from floor 110. According to the embodiment illustrated, basin 101 includes a front sidewall 121 (e.g., the sidewall of the front portion), a left sidewall 122, a right sidewall 123, and a rear sidewall 124. Front sidewall 121 extends laterally across a front portion of basin 101, rear sidewall 124 extends laterally across a rear portion of basin 101, left sidewall extends front-to-back between front sidewall 121 and rear sidewall 124 along a first side portion of basin 101 (e.g., a left side portion) and right sidewall 123 extends front-to-back between front sidewall 121 and rear sidewall 124 along a second side portion of basin 101 (e.g., a right side portion, etc.).

Figure 3:
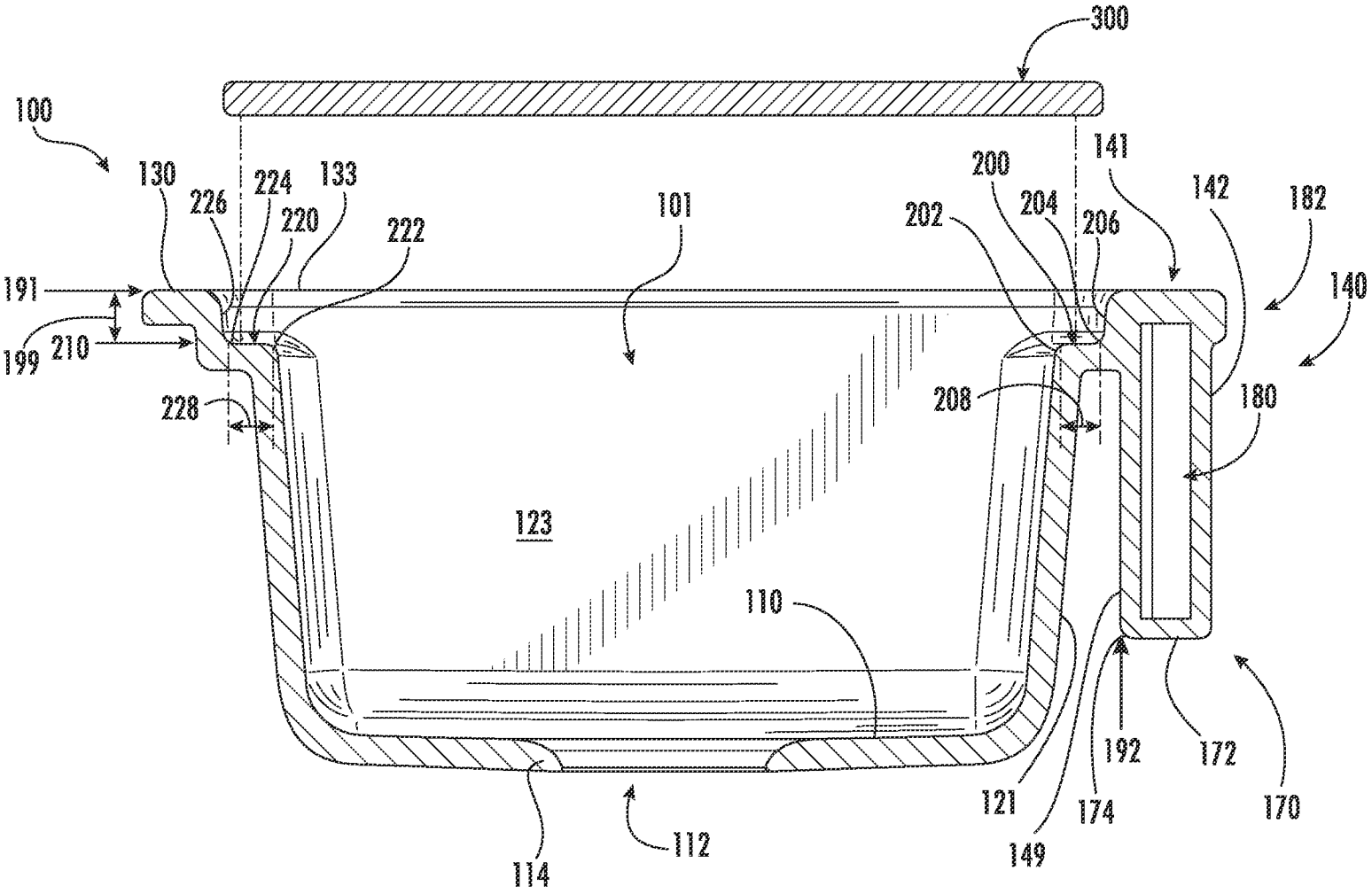
FIG. 3 is a cross-sectional view through Section A-A of the sink of FIG. 2, according to an example embodiment.
Figure 4:
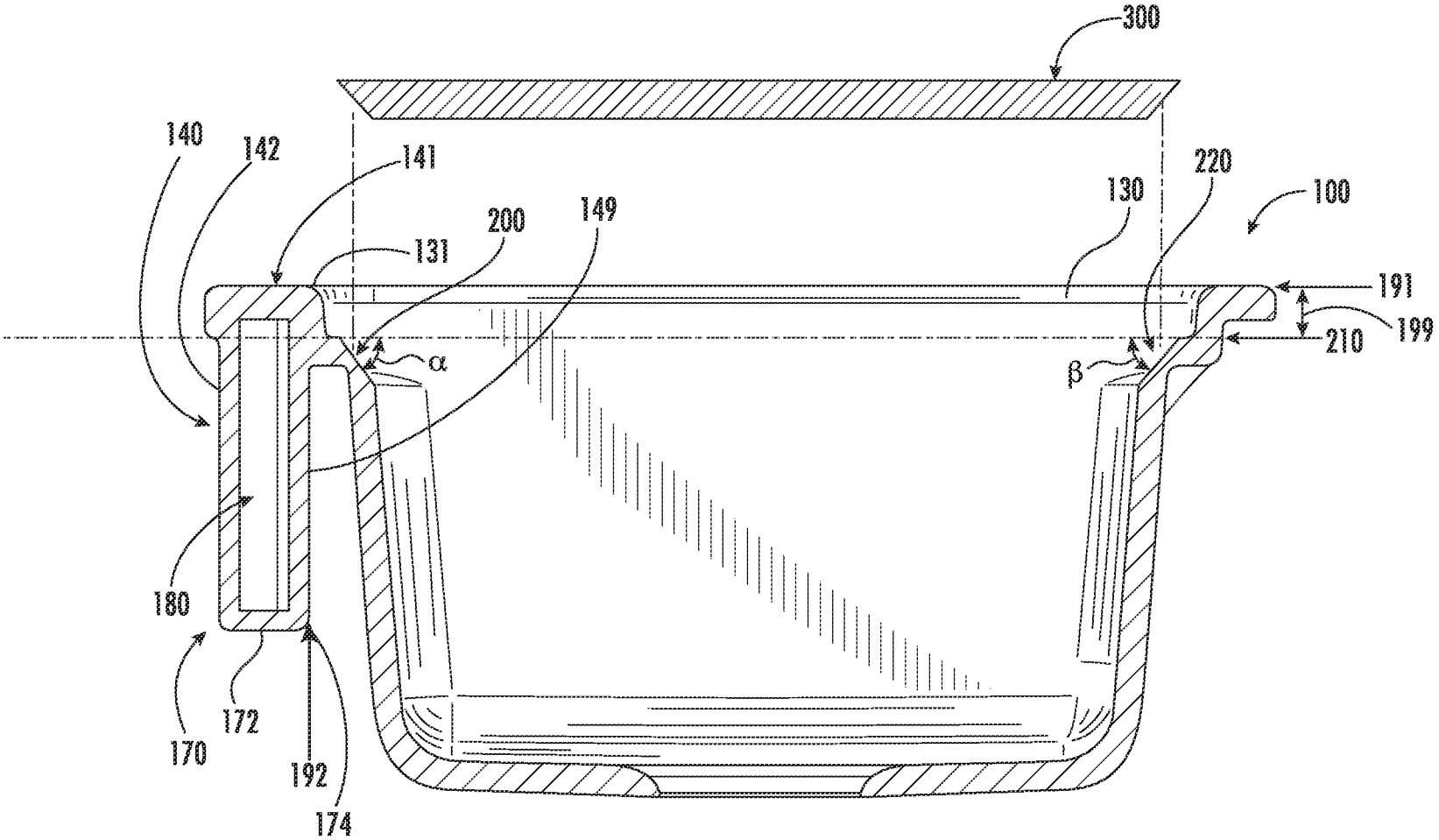
FIG. 4 is a cross-sectional view through Section B-B of the sink of FIG. 2, according to an example embodiment.
Figure 5:
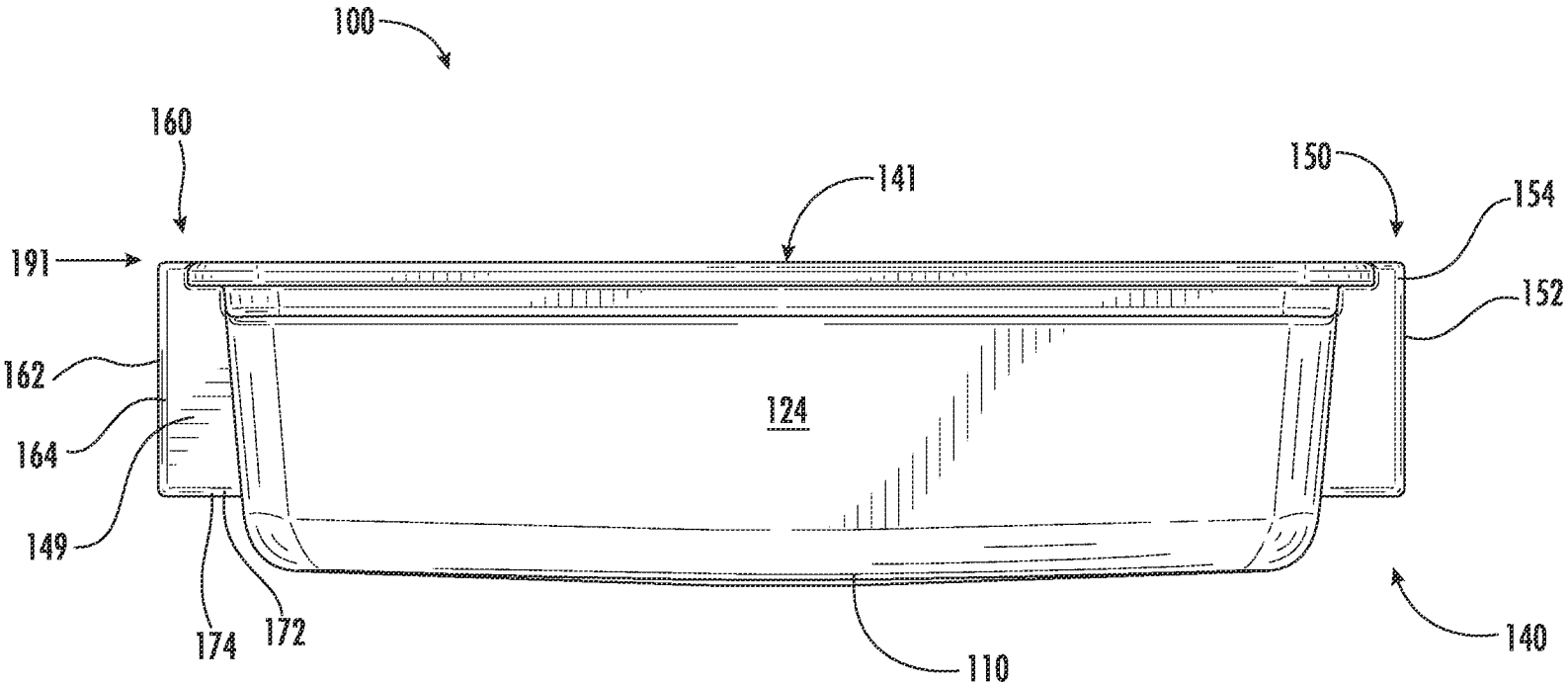
FIG. 5 is a rear planar view of the sink of FIG. 1, according to an example embodiment.
Figure 6:
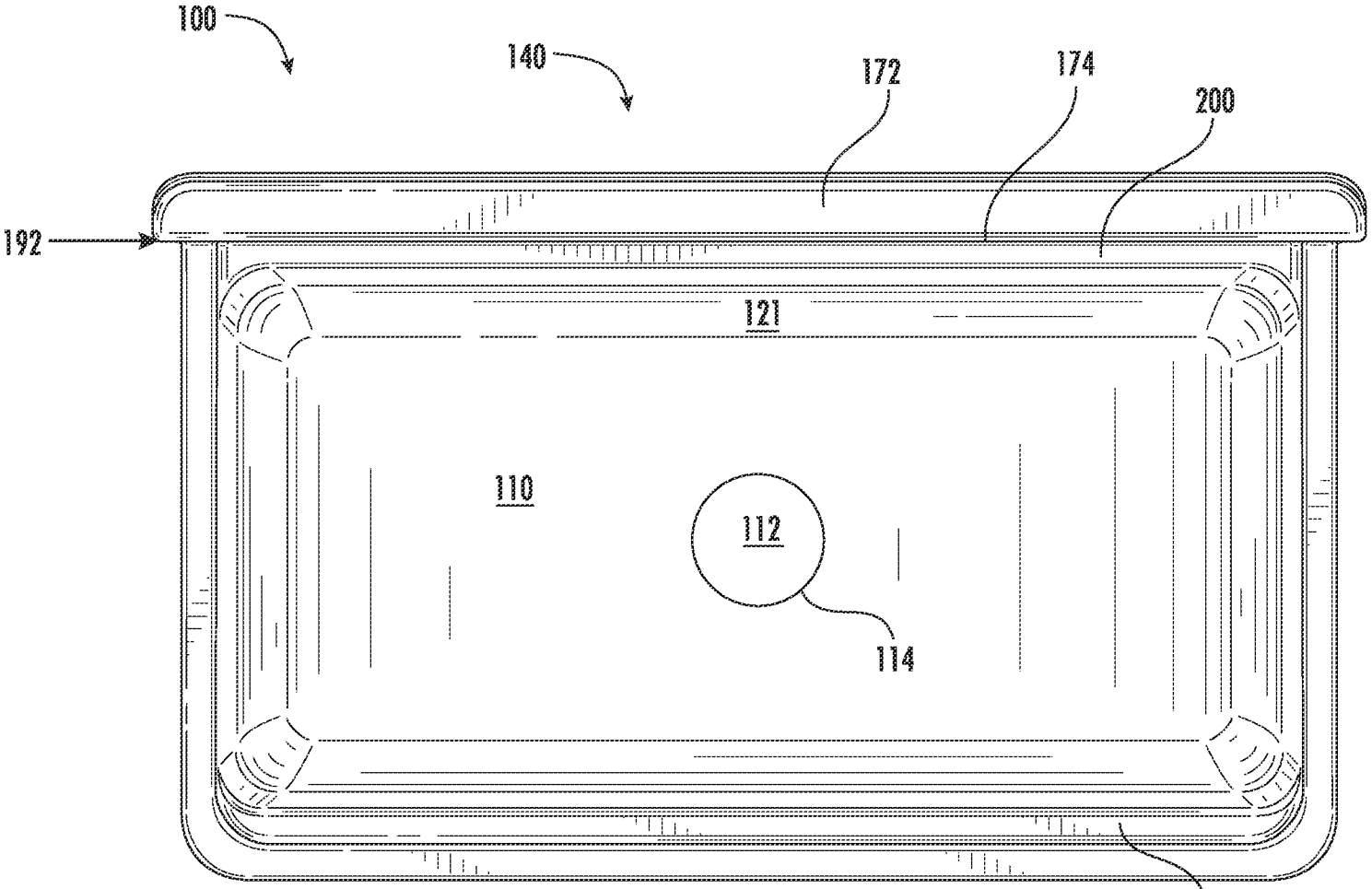
FIG. 6 is a bottom planar view of the sink of FIG. 1, according to an example embodiment.
Figure 7:
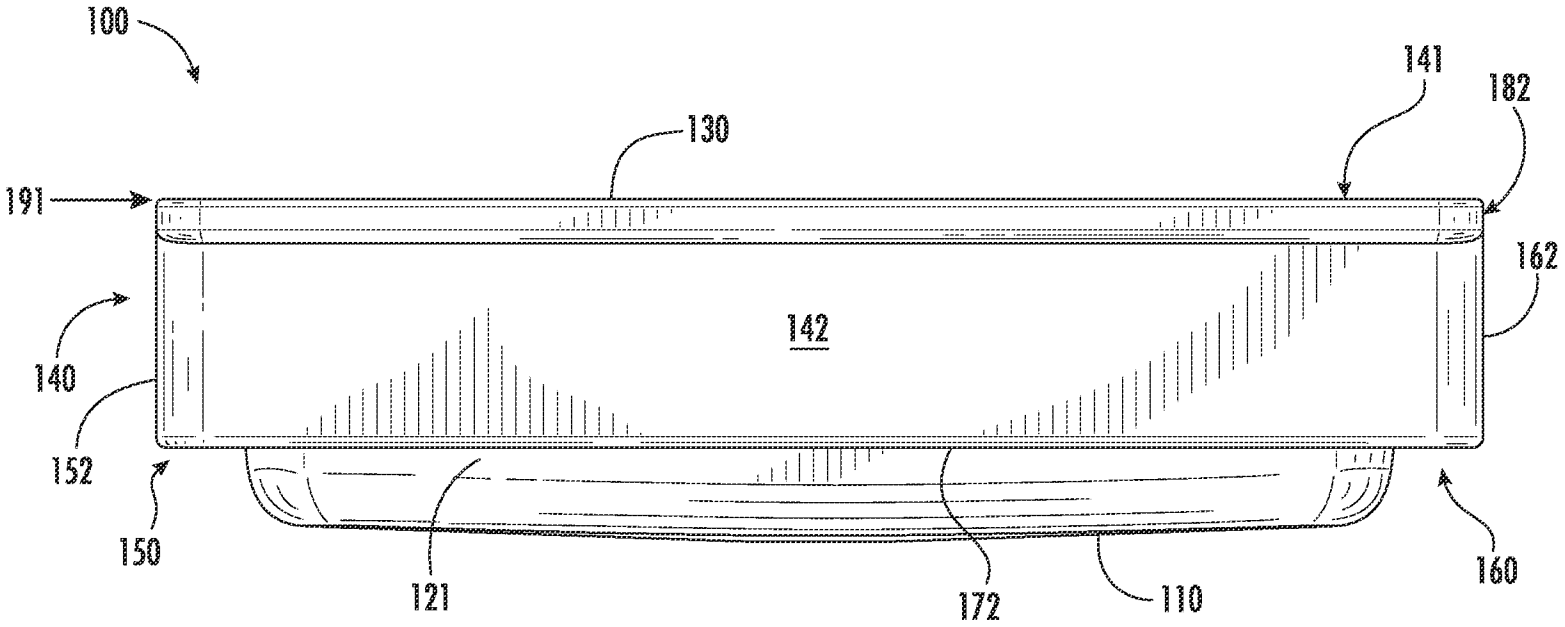
FIG. 7 is a front planar view of the sink of FIG. 1, according to an example embodiment.
Figure 8:
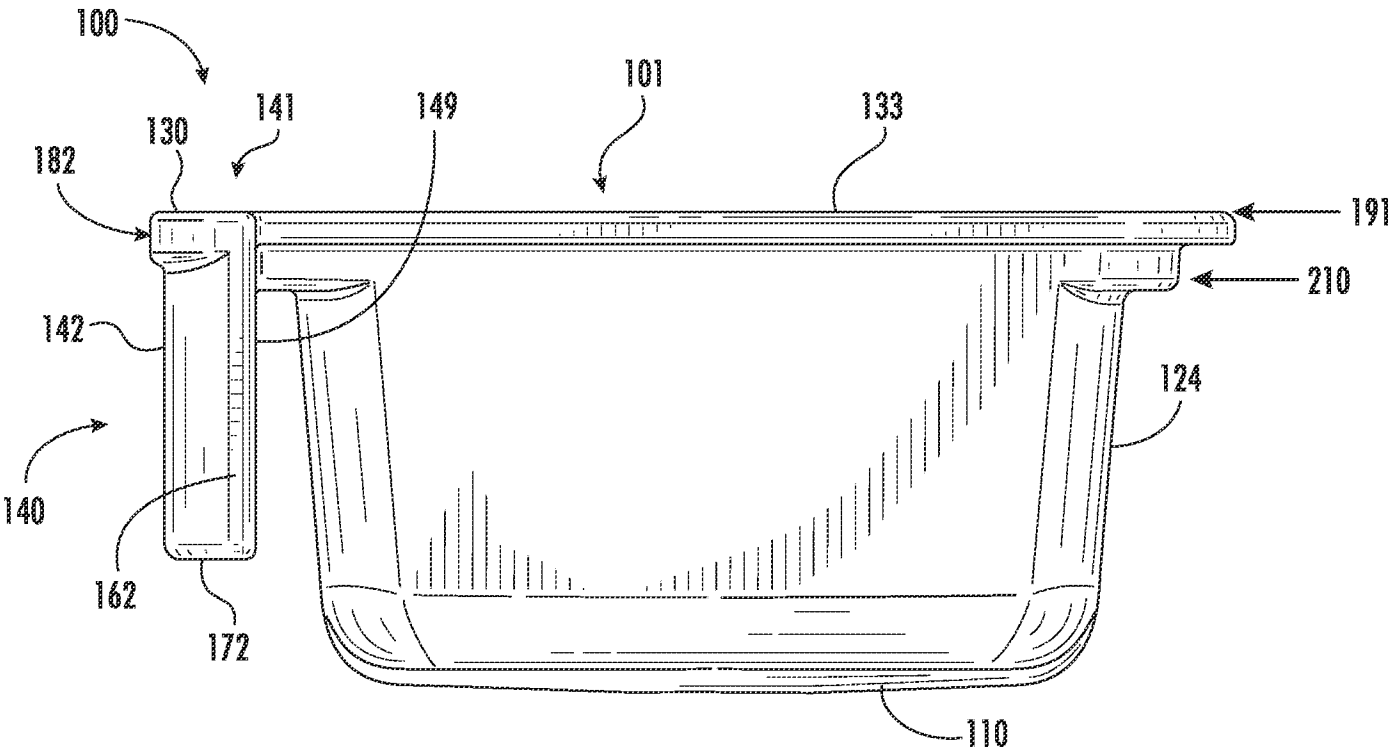
FIG. 8 is a side planar view of the sink of FIG. 1, according to an example embodiment.
Figure 9:
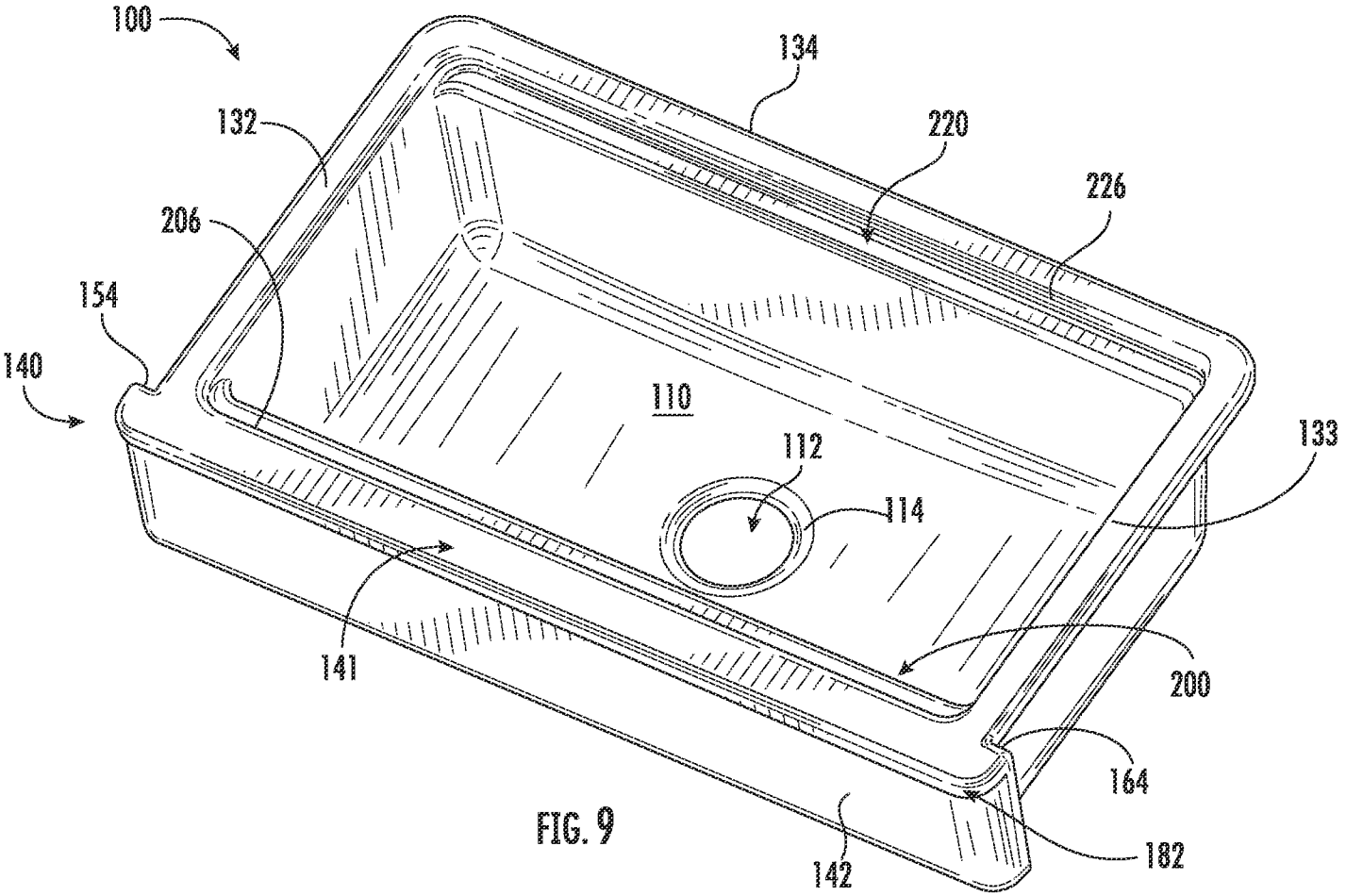
FIG. 9 is a perspective view of the sink of FIG. 1, according to an example embodiment.
Figure 10:
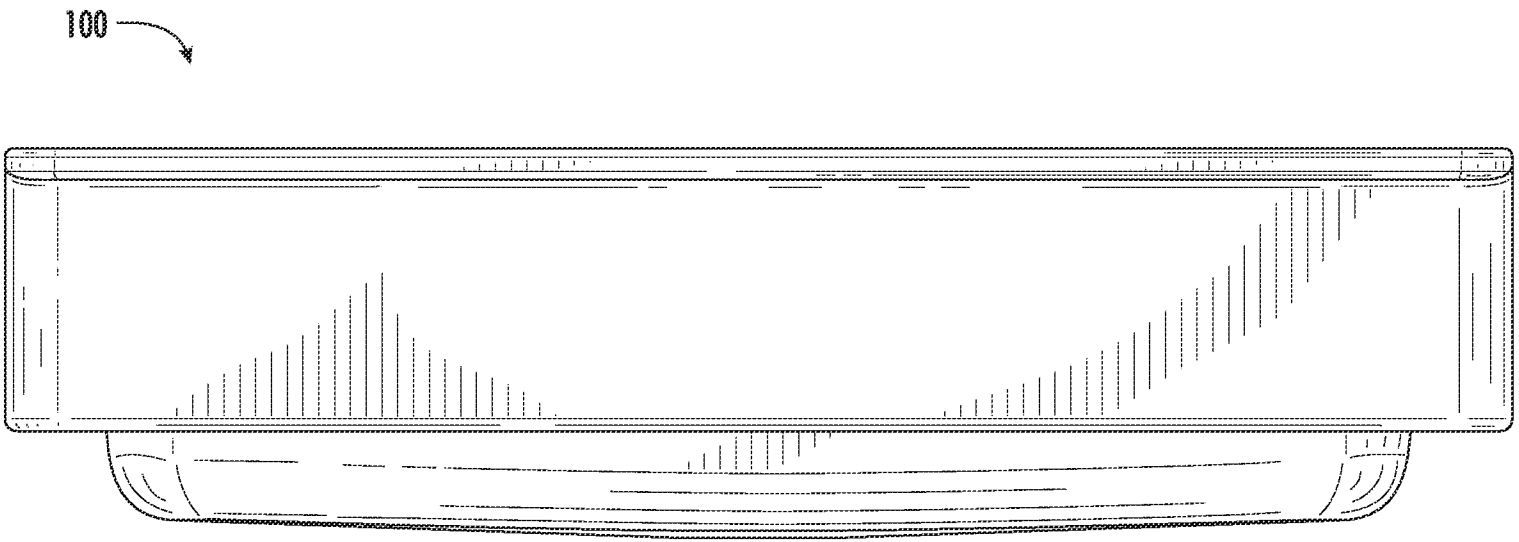
FIG. 10 is a front planar view of the sink of FIG. 1, according to an example embodiment.
Figure 11:
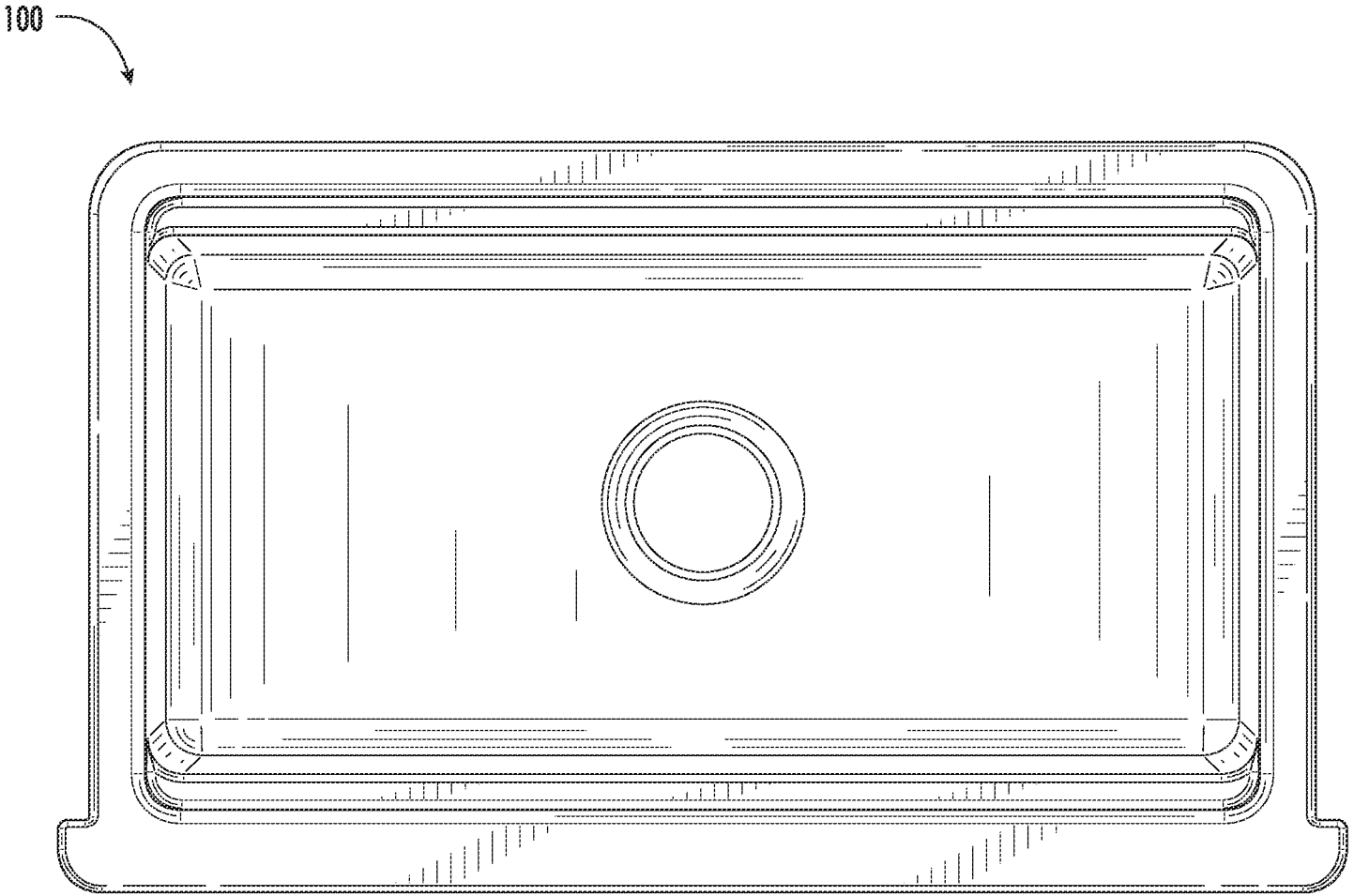
FIG. 11 is a top planar view of the sink of FIG. 1, according to an example embodiment.
Figure 12:
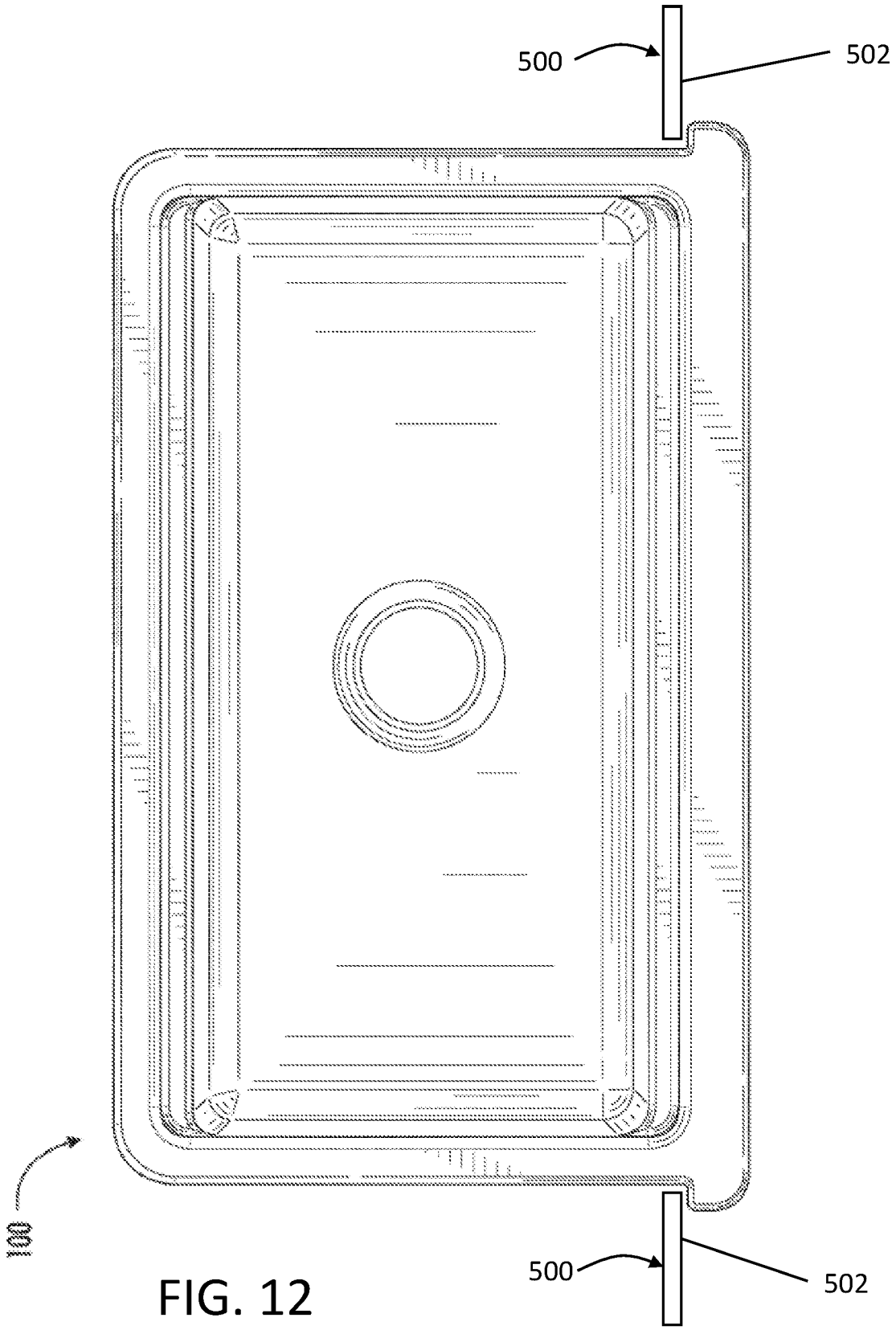
FIG. 12 is a top planar view of the sink of FIG. 1, and cabinet, according to an example embodiment.

According to an exemplary embodiment, sidewalls 120 are coupled to floor 110 at generally rounded corners which provide continuous surface transitions. For example, rear sidewall 124 couples floor 110 at bottom basin corner 126. Bottom basin corner 126 is shown to be continuously curved. As shown in FIGS. 3 and 4, the transition between sidewall 120 and floor 110 is generally concave. According to the various alternative embodiments, this transition region may be angled and/or have discontinuously curved surface transitions from floor 110 to sidewall 120. The rounded corners for each of corners floor 110 to front sidewall 121, floor 110 to left sidewall 122, floor 110 to right sidewall 123, and floor 110 to rear sidewall 124 may have the same or different radii of curvature.

Figure 2:
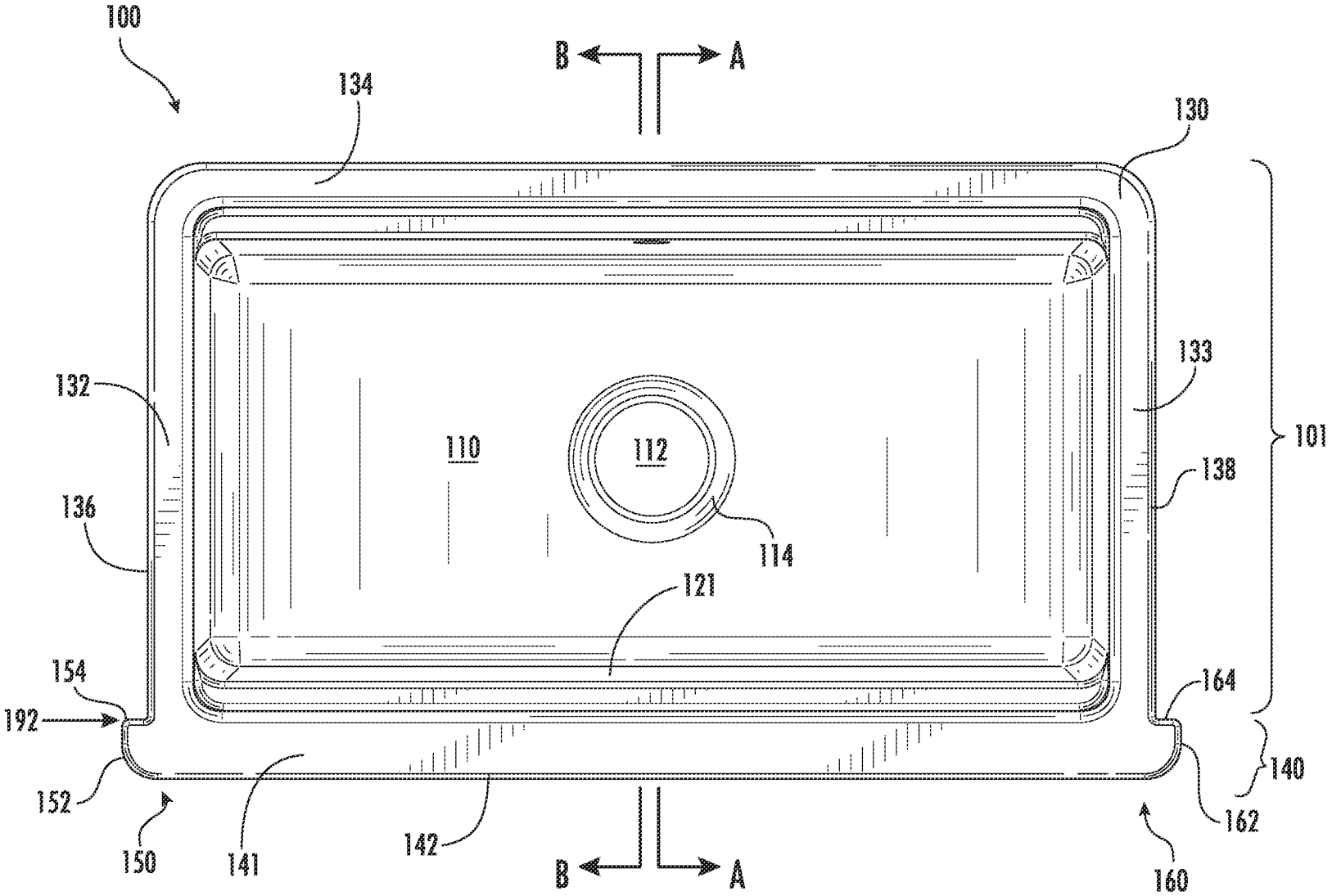
FIG. 2 is a top planar view of the sink of FIG. 1, according to an example embodiment.

According to an exemplary embodiment, sidewalls 120 are coupled to each other at generally rounded corners which provide continuous surface transitions. For example, right sidewall 123 is shown to couple rear sidewall 124 at side basin corner 128. Side basin corner 128 is shown to be continuously curved. As shown in FIG. 2, the transition between adjacent sidewalls 120 is generally concave. According to the various alternative embodiments, this transition region may be angled and/or have discontinuously curved surface transitions between adjacent sidewalls 120. The rounded corners for each of corners front sidewall 121 to left sidewall 122, left sidewall 122 to rear sidewall 124, rear sidewall 124 to right sidewall 123, and right sidewall 123 to front sidewall 121 may have the same or different radii of curvature.

Basin 101 is further shown as including one or more ledges, shown as a first ledge 200 and a second ledge 220. First ledge 200 is shown as being provided at a top edge or portion of front sidewall 121 and extending generally outwardly (i.e., in a direction opposite the center of the sink) therefrom. First ledge 200 may extend along a side-to-side width of front sidewall 121 such that front sidewall 121 terminates at first ledge 200 and no portion of front sidewall 121 extends above first ledge 200. In some embodiments, first ledge 200 is contiguous with front sidewall 121, left sidewall 122, and right sidewall 123. As shown in FIG. 2, first ledge 200 may extend laterally from front sidewall 121 and into a front portion of right sidewall 123 and left sidewall 122, slightly wrapping around the rounded corner transitions between front sidewall 121 and right sidewall 123, and between front sidewall 121 and left sidewall 122.

First ledge 200 may be planar and define a plane, shown as a ledge plane 210 in FIG. 3, parallel to a countertop when basin 101 is mounted adjacent an underside of a horizontal countertop. In some embodiments, ledge plane 210 may intersect a horizontal countertop, such as embodiments where sink 100 is a top mount sink and a portion of sink 100 rests on a top surface of the horizontal countertop. In some embodiments, first ledge 200 is positioned at an angle (e.g., tapered) such that first ledge 200 biases water into basin 101 when basin 101 is mounted adjacent an underside of a horizontal countertop. First ledge 200 may define a supporting surface configured to receive a sink accessory, such as a cutting board, a drying rack, and other similar sink accessories. In some embodiments, first ledge 200 is integrally formed with sink 100.

First ledge 200 defines a leading edge, shown as a first ledge edge 202, and a following edge, shown as a second ledge edge 204. First ledge 200 meets front sidewall 121 proximate to first ledge edge 202 such that first ledge 200 is contiguous with front sidewall 121. Second ledge edge 204 is contiguous with first ledge 200 and lies within ledge plane 210. In some embodiments, first ledge edge 202 is angular such that the transition between first ledge 200 and front sidewall 121 is continuous and non-differentiable. In some embodiments, first ledge edge 202 forms a smooth and differentiable transition between the first ledge 200 and front sidewall 121. In some embodiments, such as embodiments where first ledge 200 is parallel to a horizontal countertop, both first ledge edge 202 and second ledge edge 204 lie within ledge plane 210. In some embodiments, such as embodiments where first ledge 200 is configured to bias water into basin 101, first ledge edge 202 may be positioned below ledge plane 210 (e.g., positioned between floor 110 and ledge plane 210). First ledge 200 may extend generally outwardly from first ledge edge 202 at an angle such that second ledge edge 204 is positioned above first ledge edge 202 relative to floor 110 and such that second ledge edge 204 is positioned further from the center of basin 101 than first ledge edge 202.

Contiguous with first ledge 200 and opposite front sidewall 121 may be a first upper portion 206. First upper portion 206 may extend away from second ledge edge 204 in a direction generally away from the front sidewall 121 and parallel to a portion of front sidewall 121 proximate to first ledge edge 202. First upper portion 206 may be contiguous with right sidewall 123 and left sidewall 122. Generally speaking, first ledge 200 interrupts front sidewall 121, separating front sidewall 121 from first upper portion 206. For example, first ledge 200 may, between first ledge edge 202 and second ledge edge 204, extend parallel to front sidewall 121 such that front sidewall 121 is effectively extended, now including first ledge 200 and first upper portion 206.

Second ledge 220 is shown as being provided at a top edge or portion of rear sidewall 124 and extending generally outwardly (i.e., in a direction opposite the center of the sink) therefrom. Second ledge 220 may extend along a side-to-side width of rear sidewall 124 such that rear sidewall 124 terminates at second ledge 220 and no portion of rear sidewall 124 extends above second ledge 220.

In some embodiments, second ledge 220 is contiguous with rear sidewall 124, left sidewall 122, and right sidewall 123. As shown in FIG. 2, second ledge 220 may extend laterally from rear sidewall 124 and into a rear portion of right sidewall 123 and a rear portion of left sidewall 122, slightly wrapping around the rounded corner transitions between rear sidewall 124 and right sidewall 123, and rear sidewall 124 and left sidewall 122.

Second ledge 220 may be planar and lie within ledge plane 210, planar with first ledge 200 and parallel to a countertop when basin 101 is mounted adjacent an underside of a horizontal countertop. In some embodiments, second ledge 220 is positioned at an angle (e.g., tapered) such that second ledge 220 biases water into basin 101 when basin 101 is mounted adjacent an underside of a horizontal countertop. Second ledge 220 and first ledge 200 may be discontinuous such that second ledge 220 is separate from first ledge 200, separated by right sidewall 123 and left sidewall 122.

Second ledge 220 defines a leading edge, shown as a first ledge edge 222, and a following edge, shown as a second ledge edge 224. Second ledge 220 meets rear sidewall 124 proximate to first ledge edge 222 such that second ledge 220 is contiguous with rear sidewall 124. Second ledge edge 224 is contiguous with second ledge 220 and lies within ledge plane 210. In some embodiments, first ledge edge 222 is angular such that a transition between second ledge 220 and rear sidewall 124 is continuous and non-differentiable. In some embodiments, first ledge edge 222 forms a smooth and differentiable transition between the second ledge 220 and rear sidewall 124. In some embodiments, such as embodiments where second ledge 220 is parallel to a horizontal countertop, both first ledge edge 222 and second ledge edge 224 lie within ledge plane 210. In some embodiments, such as embodiments where second ledge 220 is configured to bias water into basin 101, first ledge edge 222 may be positioned below ledge plane 210 (e.g., positioned between floor 110 and ledge plane 210). Second ledge 220 may extend generally outwardly from first ledge edge 222 at an angle such that second ledge edge 224 is positioned above first ledge edge 222 relative to floor 110 and such that second ledge edge 224 is positioned further from the center of basin 101 than first ledge edge 222.

Contiguous with second ledge 220 and opposite rear sidewall 124 may be a second upper portion 226. Second upper portion 226 may extend away from second ledge edge 224 in a direction generally away from rear sidewall 124 and parallel to a portion of rear sidewall 124 proximate to first ledge edge 222. Second upper portion 226 may be contiguous with right sidewall 123 and left sidewall 122. Generally speaking, second ledge 220 interrupts rear sidewall 124, separating rear sidewall 124 from second upper portion 226. For example, second ledge 220 may, between first ledge edge 222 and second ledge edge 224, extend parallel to rear sidewall 124 such that rear sidewall 124 is effectively extended, now including second ledge 220 and second upper portion 226.

It may be desirable, in some embodiments, to position first ledge 200 opposite to (e.g., across from) second ledge 220. For example, if first ledge 200 is positioned proximate to front sidewall 121 and contiguous with front sidewall 121 and first upper portion 206, then second ledge 220 may be positioned proximate to rear sidewall 124 and contiguous with rear sidewall 124 and second upper portion 226. In another example, if first ledge 200 is positioned proximate to right sidewall 123, then second ledge 220 may be positioned proximate to left sidewall 122 such that an auxiliary component may interface with both first ledge 200 and second ledge 220 while being positioned above floor 110.

As shown in FIGS. 3 and 4, first ledge 200 may define a distance, shown as a first ledge length 208. First ledge length 208 is defined as a distance between first ledge edge 202 and second ledge edge 204. Second ledge 220 may define a distance, shown as a second ledge length 228. Second ledge length 228 is defined as a distance between first ledge edge 222 and second ledge edge 224. In some embodiments, first ledge length 208 is equal to second ledge length 228. While the value of first ledge length 208 and second ledge length 228 may change from side-to-side, first ledge length 208 and second ledge length 228 may be equal for a given side cross-section of basin 101.

In some embodiments, as shown in FIG. 4, first ledge 200 is positioned at a first angle relative to the ledge plane 210, shown as angle α. Similarly, second ledge 220 may be positioned at a second angle relative to the ledge plane 210, shown as angle β. Angle α and angle β may be equal for a given cross-section of basin 101. In some embodiments, angle α and angle β are between 20-degrees and 50-degrees. In some embodiments, a and angle β are between 30-degrees and 40-degrees. In some embodiments, angle α and angle β are 35-degrees. In some embodiments angle α and angle β are between 0-degrees and 5-degrees.

As shown in FIGS. 3 and 4, first ledge 200 and second ledge 200 may be configured to define supporting surfaces configured to receive a sink accessory, such as a sink accessory 300.

Sink accessory 300 may define sloped edges that match angle α and angle β such that the top surface of the sink accessory 300 is parallel with rim plane 191. In some embodiments, first ledge 200, second ledge 220, first upper portion 206, and second upper portion 226 all cooperate to receive sink accessory 300 such that sink accessory 300 is prevented from moving away from basin 101 when force is applied to sink accessory 300 in a direction generally toward floor 110 or toward sidewalls 120.

Basin 101 is further shown as including one or more flanges or rims (generically referred to as a rim 130) that at least partially define an outer and/or upper periphery of basin 101. Rim 130 is shown as being provided at a top edge or portion of the basin 101 and extending generally outwardly (i.e., in a direction opposite the center of the sink) therefrom. According to the embodiment illustrated, basin 101 includes a front rim 131, a left rim 132, a right rim 133, and a rear rim 134. Front rim 131 extends outwardly from a top edge or portion of first upper portion 206, left rim 132 extends outwardly from a top edge or portion of left sidewall 122, right rim 133 extends outwardly from a top edge or portion of right sidewall 123, and rear rim 134 extends outwardly from a top edge or portion of second upper portion 226. The thickness of rim 130 may be the same or different than the thickness of sidewall 120. Further, the individual thicknesses of each of the front rim 131, the left rim 132, the right rim 133, and/or the rear rim 134 may be the same or different. The individual widths of each of the front rim 131, the left rim 132, the right rim 133, and/or the rear rim 134 may also be the same or different. According to the embodiment illustrated, left rim 132 and right rim 133 have a substantially similar width, which is larger than the width of rear rim 134. Providing a narrower rear rim 134 may provide additional clearance for faucets, soap dispensers, etc. that are likely to be mounted behind the sink. Providing a wider left rim 132 and right rim 133 may provide additional surface areas for mounting the sink to an underside of a countertop as detailed below. In some embodiments, sink 100 is a top mount sink and interfaces with a top surface of a horizontal countertop. In such embodiments, rim 130 may rest on the countertop, rim 130 supporting basin 101. Front rim 131, left rim 132, right rim 133, and rear rim 134 are shown to form a continuous rim surface. According to alternative embodiments, rim 130 may be formed of discontinuous rim segments.

According to an exemplary embodiment, sink 100 is configured to be supported by rim 130. For example, sink 100 may be supported by an underside surface of rim 130, such as by having rim 130 rest on top of a countertop or any other suitable support surface. According to an exemplary embodiment, sink 100 is configured to be supported by having a bottom portion of rim 130 directly engage the support structure. According to another embodiment, rim 130 may be supported against a bottom surface of a countertop. For example, a top surface of rim 130 may be coupled to a bottom surface of a countertop or support structure via one or mechanical fasteners and/or an adhesive.

According to an exemplary embodiment, rim 130 is coupled to left sidewall 122, right sidewall 123, first upper portion 206, and second upper portion 226 at generally rounded corners which provide continuous surface transitions. For example, rear rim 134 is shown to as being coupled to second upper portion 226 at top basin corner 129, which is shown to be continuously curved. As shown in FIGS. 3 and 4, the transition between rim 130 and the corresponding surface (e.g., left sidewall 122, right sidewall 123, first upper portion 206, second upper portion 226) is generally convex. According to alternative embodiments, this transition region may be angled and/or have discontinuously curved surface transitions from rim 130 to the corresponding surface. The rounded corners for each of corners front rim 131 to first upper portion 206, left rim 132 to left sidewall 122, right rim 133 to right sidewall 123, and rear rim 134 to second upper portion 226 may have the same or different radii of curvature.

Rim 130 defines a first plane (e.g., top plane), shown as rim plane 191 (see FIGS. 3 and 4). According to the embodiment illustrated, front rim 131, left rim 132, right rim 133 and/or rear rim 134 cooperate to define rim plane 191. According to the exemplary embodiment, rim plane 191 is a generally horizontal plane. Rim 130 may be sloped slightly inward so that any fluid collected on the rim will be directed towards basin 101 and ultimately towards drain 112.

For example, a portion of rim 130 proximate sidewall 121 may be lower than a portion of rim 130 distal sidewall 121. According to the embodiment illustrated, front rim 131 is supported at an angle of approximately 2 degrees relative to rim plane 191, but according to the various alternative embodiments, may be supported at angles greater or less than the example provided.

A distance between rim plane 191 and ledge plane 210 is shown as a plane distance 199. Plane distance 199 is equal to a vertical height of each of first upper portion 206 and second upper portion 226. Similarly, right sidewall 123 and left sidewall 122 extend above ledge plane 210 and terminate proximate to rim plane 191, right sidewall 123 and left sidewall 122 extending a vertical distance approximately equal to plane distance 199. In some embodiments, plane distance 199 is equal to first ledge length 208 and second ledge length 228.

Referring back to FIG. 2, left rim 132 has a first edge, shown as left rim edge 136, and right rim 133 has a second edge, shown as right rim edge 138. Left rim edge 136 and/or right rim edge 138 may at least partially define an outer periphery of basin 101. According to an exemplary embodiment, the distance from left rim edge 136 to right rim edge 138 is approximately 34 inches, and the distance from left sidewall 122 to right sidewall 123 is approximately 31 inches. According to another exemplary embodiment, left rim edge 136 and right rim edge 138 are approximately 31 inches apart, for a reservoir that has a width of approximately 28 inches. According to the embodiment illustrated, left rim edge 136 and right rim edge 138 are approximately 28 inches apart for a reservoir that has a width of approximately 25 inches. According to various alternative embodiments, the rim may be sized to be greater or less than the dimensions provided above.

Referring back to FIGS. 1 and 2, apron 140 extends laterally across a front portion of basin 101 to define a front portion of the sink that is configured to be visible to a user when installed. As shown, apron 140 is coupled to the basin 101 and is supported at a substantially vertical orientation. According to an exemplary embodiment, apron 140 includes a first surface (e.g., structure, member, etc.), shown as top flange 141, a second surface (e.g., structure, member, etc.), shown as front face 142, a first end surface, shown as left end portion 150, and a second end surface, shown as right end portion 160. Left end portion 150 is shown as being located laterally opposite of right end portion 160.

Top flange 141 extends outwardly in a forward direction from front sidewall 121 and front rim 131. According to various embodiments, a top surface of apron 140 may be substantially defined by top flange 141, rim 130, or any combination thereof. According to the embodiment illustrated, the transition from top flange 141 to front rim 131 is substantially continuous. Similarly, the transition from top flange 141 to left rim 132, and the transition from top flange 141 to right rim 133, is also substantially continuous. According to an exemplary embodiment, front face 142 extends generally downwardly from top flange 141 in a vertical direction.

Top flange 141 is shown to extend laterally to left end portion 150 and to right end portion 160. Left end portion 150 and right end portion 160 form extension or wing portions that are configured to at least partially overlap or cover a portion of the cabinetry 500 or other structure upon which the sink is supported. Left end portion 150 includes an end surface, shown as left end surface 152 that extends generally rearwardly. Left end surface 152 has a rear edge 154 that is configured to abut or be positioned adjacent a front face 502 of the cabinetry 500 supporting sink 100. According to the embodiment illustrated, left end surface 152 and/or rear edge 154 define a lateral extremity of apron 140 and a rearward extremity of left end portion 150. Similarly, right end portion 160 includes an end surface, shown as right end surface 162 that extends generally rearwardly. Right end surface 162 has a rear edge 164 that is configured to abut or be positioned adjacent a front face 502 of the cabinetry 500 supporting sink 100. According to the embodiment illustrated, right end surface 162 and/or rear edge 164 define a lateral extremity of apron 140 and a rearward extremity of right end portion 160.

According to an exemplary embodiment, top flange 141 couples each of front face 142, left end surface 152, and right end surface 162 at generally rounded corners which provide a continuous surface transition. For example, top flange 141 is shown to couple front face 142 at top apron corner 144. Top apron corner 144 is shown to be continuously curved. Referring to FIGS. 3 and 4, the transition region between top flange 141 and front face 142 is generally convex. According to the various alternative embodiments, this transition region be angled and/or have discontinuously curved surface transitions from top flange 141 to front face 142.

The rounded corners for each of corners top flange 141 to front face 142, top flange 141 to left end surface 152, and top flange 141 to right end surface 162 may have the same or different radii of curvature.

In some embodiments, the transition region between top flange 141 and front face 142 includes a flange, shown as a front lip 182. Front lip 182 may extend laterally away from front face 142 and be contiguous with top flange 141.

According to an exemplary embodiment, front face 142 couples each of left end surface 152 and right end surface 162 at generally rounded corners which provide a continuous surface transition. For example, front face 142 is shown to couple left end surface 152 at side apron corner 145. Side apron corner 145 is shown to be continuously curved. Referring to FIG. 2, the transition region between front face 142 and left end surface 152 is generally convex. According to the various alternative embodiments, this transition region may be angled and/or have discontinuously curved surface transitions from front face 142 to left end surface 152. The rounded corners for each of corners front face 142 to left end surface 152 and front face 142 to right end surface 162 may have the same or different radii of curvature.

As shown in FIGS. 1 and 2, apron 140 extends laterally beyond rim 130. Specifically, left end portion 150 extends leftward of left rim 132, while right end portion 160 extends rightward of right rim 133. In this manner, left end portion 150 and right end portion 160 extends laterally beyond the outer periphery defined by rim 130. According to an exemplary embodiment, apron 140 is also wider than basin 101.

In certain applications, having apron 140 extend beyond the width of basin rim 130 may allow a customer or installer to cut an opening in a cabinet face and to set the sink in the cabinet with little cabinet modification and/or without being concerned about making a precise cut in the cabinetry that would be visible to a user after the sink is installed. In such an application, left end surface 152 and right end surface 162 extend beyond the area in which cuts are made in the cabinetry to install sink 100. Thus, apron 140 overlaps the front face of the cabinet and may extend nearly the width of the cabinet. Traditional sinks having an equivalent apron width would require an installer to cut into the walls of the cabinet all the way to the ends of the apron.

Furthermore, placing left end surface 152 and right end surface 162 farther outward facilitates aligning the lateral ends of the apron with the lateral edges of doors below the installed sink.

Referring to FIGS. 3 and 4, a backside of apron 140 defines a second plane, shown as rear apron plane 192. Rear apron plane 192 is shown as being substantially vertical. According to the embodiment illustrated, rear apron plane 192 is substantially perpendicular to rim plane 191 and substantially parallel to front face 142. Having a substantially vertical rear apron plane provides a substantially flat backside to the apron. Rear apron plane 192, may be configured to abut a front surface of a cabinet when sink 100 is in an installed position. As such, when sink 100 is installed, the apron may fit flush against the front of the cabinet instead of dropping into a cut or an opening. This may save the installer iterative cutting and fitting, which requires repeated lifting of the sink.

Apron 140 is also shown as including a third end portion, shown as bottom end portion 170. Bottom end portion 170 includes a third end surface, shown as bottom end surface 172. According to one embodiment, bottom end surface 172 extends generally rearwardly from front face 142. Bottom end surface 172 has a rear edge 174 that is coplanar with rear apron plane 192. According to the embodiment shown, rear apron plane 192 is defined by rear edge 154, rear edge 164, and rear edge 174.

According to an exemplary embodiment, bottom end surface 172 is coupled to each of front face 142, left end surface 152, and right end surface 162 at generally rounded corners which provide a continuous surface transition. According to the embodiment illustrated, this transition region is continuously curved and generally convex. According to the various alternative embodiments, this transition region may be angled and/or have discontinuously curved surface transitions from the bottom end surface to the adjacent surfaces. The rounded corners for each of corners bottom end surface 172 to front face 142, bottom end surface 172 to left end surface 152, and bottom end surface 172 to right end surface 162 may have the same or different radii of curvature. According to the exemplary embodiment shown, the radii of curvature for the corners adjacent to bottom end surface 172 are greater than the radii of curvature for the corners adjacent to top flange 141, for example, top apron corner 144.

As shown in FIG. 4, apron 140 is shown as defining a cavity 180 (e.g., recess, depression, carve-out, hollow, etc.). Cavity 180 may be formed by a variety of methods.

According to an exemplary embodiment, sink 100 is formed of fireclay and cavity 180 is formed by placing an insert into the mold prior to casting sink 100. Cavity 180 may reduce the amount of material in sink 100, which may reduce the overall weight of sink 100. Cavity 180 may improve the consistency and quality of the apron 140 as the fireclay is cured. When fireclay is cured (e.g., fired, baked in a kiln, etc.), the raw fireclay may shrink and expand. The cavity 180 provides space for the fireclay to expand and contract, both while curing and during normal use, such that the fireclay, and specifically apron 140, will not crack. Cavity 180 may also reduce the weight of the apron cantilevered from basin 101 when sink 100 is in an installed position, thus reducing the load on top flange 141. Reducing the weight of the apron cantilevered from basin 101 facilitates positioning front face 142 farther forward. Positioning front face 142 farther forward enables positioning a top portion of front sidewall 121 farther forward, which facilitates access to the reservoir by a user. Positioning front face 142 farther forward may define a drip line from apron 140 farther forward than front surfaces of doors located below apron 140 when sink 100 is in an installed position. Cavity 180 removes material from a rear portion of apron 140, which allows rear apron plane 192 to be defined by edges 154, 164, and 174, thus facilitating tighter control of tolerances.

Apron 140 has a rear surface 149 disposed on the reverse of front face 142. Rear surface 149 may at least partially define cavity 180. According to one embodiment, rear surface 149 is generally planar. According to the embodiment illustrated, the cross section of apron 140 is substantially rectangular in a vertical direction. The cavity 180 is positioned between the front face 142 and the rear face 149.

Referring back to FIGS. 2-4, and the configuration of the sidewalls 120 of basin 101, first upper portion 206 is shown as being provided at an angle relative to rim plane 191. The front sidewall 121 may be provided at an angle similar to, or exactly equal to, the angle provided by the first upper portion 206. According to an exemplary embodiment, first upper portion 206 and front sidewall 121 are supported at an angle relative to rim plane 191 of between approximately 80 and 89 degrees. Preferably, first upper portion 206 and front sidewall 121 are supported at an angle relative to rim plane 191 of between approximately 82 and 87 degrees. According to the embodiment illustrated, first upper portion 206 and front sidewall 121 and supported at an angle relative to rim plane 191 of approximately 85 degrees. According to the various alternative embodiments, first upper portion 206 and front sidewall 121 may be provided at any angle relative to the rim plane 191 (e.g., between 90 and 0 degrees). In some embodiments, first upper portion 206 and front sidewall 121 are provided at different angles relative to the rim plane 191.

Considering a different reference point, first upper portion 206 and front sidewall 121 are supported at an angle relative to rear apron plane 192 of between approximately 1 and 10 degrees. Preferably, first upper portion 206 and front sidewall 121 are supported at an angle relative to rear apron plane 192 of between approximately 3 and 7 degrees. According to the embodiment illustrated, first upper portion 206 and front sidewall 121 are supported at an angle relative to rear apron plane 192 of approximately 5 degrees. According to the various alternative embodiments, first upper portion 206 and front sidewall 121 may be provided at any angle relative to the rear apron plane 192 that slants first upper portion 206 and front sidewall 121 towards the center of basin 101. In some embodiments, first upper portion 206 and front sidewall 121 are provided at different angles relative to rear apron plane 192.

As shown in FIGS. 3 and 4, bottom end portion 170, bottom end surface 172, and rear edge 174 are offset or spaced apart from front sidewall 121. According to an exemplary embodiment, no supports (e.g. structures, members, spars, flanges, webs, etc.) extend between front sidewall 121 and apron 140 other than rim 130. Disconnecting the bottom of apron 140 from front sidewall 121 enables a portion the cabinet to fit between the apron and the basin. This enables apron 140 to be installed flush to a front face of the cabinet. Further this requires less precise cutting by an installer because the cut edges of the cabinet will be hidden from view.

Sink 100 may be formed of any suitably rigid material. Basin 101 and apron 140 may be the same or different materials. Basin 101 and apron 140 may be one piece or may be constructed of several pieces coupled together (e.g., welded, stir-welded, soldered, sweated, joined, fastened, adhesively bonded, etc.). Basin 101 and apron 140 may be formed by any suitable means (e.g., stamping, casting, forging, bending, hammering, etc.). According to an exemplary embodiment, sink 100 is a single piece of cast iron. Forming the sink from cast iron may allow for the sink to have a tighter tolerance than a sink formed of fireclay. Tighter tolerances may facilitate configuring rear edge 154 and rear edge 164 to align with standard door widths, and configuring rear edge 174 to align with standard door and/or drawer heights. Tighter tolerances may also enable an installer to cut a cabinet from measurements or a template, rather than iterative cutting and fitting of the sink to the cabinet. Tighter tolerances may further ensure that sink 100 will fit into a standard cabinet, as opposed to modifying a standard cabinet or ordering a custom cabinet often required with conventional apron-front sinks.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. An undermount apron-front sink comprising:

a basin having a first side wall, an opposite second side wall, a front wall, and a rear wall;

a ledge supported at and extending outwardly from an upper end of one of the front wall and the rear wall;

an upper portion extending upwardly from an outer edge of the ledge;

a rim extending outwardly from an upper edge of the upper portion in a substantially horizontal orientation to form a continuous planar surface configured to be mounted abutting an underside of a horizontal countertop; and an apron coupled with the basin, the apron comprising:

a right end portion that extends rightward of the rim and a left end portion that extends leftward of the rim such that the apron is wider than the basin;

a front face that extends vertically below the rim; and a rear face opposite to the front face, the rear face configured to engage a vertical surface of a cabinet when the rim is mounted abutting the horizontal countertop, wherein the rear face defines a planar surface that extends continuously between the right end portion and the left end portion, wherein the apron is hollow and defines an apron cavity between the front face and the rear face, the apron cavity substantially completely enclosed and extending between the right end portion and the left end portion.

2. The sink of claim 1, wherein the right end portion and the left end portion are configured to at least partially overlap a front face of the cabinet on which the sink is supported.

3. The sink of claim 2, wherein the front face is substantially parallel to the rear face.

4. The sink of claim 2, wherein the rim is configured to be supported by right and left side supports of the cabinet when the sink is installed into the cabinet.

5. The sink of claim 1, wherein the apron is offset from the basin forming a gap between the front wall of the basin and the rear face of the apron under the rim.

6. The sink of claim 1, wherein the apron further includes a top flange that couples the apron to the rim, and wherein the front wall of the basin is angled downwardly and rearwardly from the rim to a floor of the basin.

7. The sink of claim 1, wherein the apron further comprises a front lip extending laterally away from the front face proximate to the rim.

8. The sink of claim 1, wherein the apron is formed of fireclay.

9. The sink of claim 1, wherein:

the right end portion includes a right side corner that continuously curves to a right end surface; and the left end portion includes a left side corner that continuously curves to a left end surface.

10. An undermount apron-front sink comprising:

a basin having a first side wall, an opposite second side wall, a front wall, and a rear wall;

a first ledge supported at and extending outwardly from an upper end of the front wall;

a second ledge supported at and extending outwardly from an upper end of the rear wall;

a rim offset from the first ledge and the second ledge and extending outwardly from the basin in a substantially horizontal orientation to form a continuous planar surface configured to be mounted abutting an underside of a horizontal countertop;

a first upper portion extending between the rim and the first ledge, the first upper portion extending in a direction substantially parallel to the front wall;

a second upper portion extending between the rim and the second ledge, the second upper portion extending in a direction substantially parallel to the rear wall; and an apron coupled with the basin and forming a portion of the rim, the apron including a front face and a rear face defining a planar surface extending continuously across a width of the apron, wherein the apron is hollow and defines an apron cavity positioned between the front face and the rear face, the apron cavity substantially completely enclosed and extending between a right end portion and a left end portion.

11. The sink of claim 10, wherein the apron cavity is configured to allow contraction and expansion of the apron to prevent cracking.

12. The sink of claim 10, wherein the first ledge and the second ledge are substantially parallel to the rim and define a ledge plane, the ledge plane offset by a first distance from a rim plane defined by the rim.

13. The sink of claim 10, wherein the first ledge is positioned at a first angle relative to a rim plane defined by the rim, the first ledge configured to bias water into the basin when the basin is mounted abutting the underside of the horizontal countertop; and wherein the second ledge is positioned at a second angle relative to the rim plane, the second ledge configured to bias water into the basin when the basin is mounted abutting the underside of the horizontal countertop.

14. The sink of claim 13, wherein the first angle is between approximately 25-50 degrees, inclusive, and wherein the second angle is between approximately 25-50 degrees, inclusive.

15. An undermount apron-front sink comprising: a basin including at least one basin wall;

a ledge supported at and extending outwardly from an upper end of the at least one basin wall;

an apron coupled with the basin and including a top flange, a front face, a rear face, and a cavity positioned between the front face and the rear face;

a rim coupling the apron to the at least one basin wall, the rim being continuous and coplanar with the top flange; and an upper portion extending between the rim and the ledge, the upper portion extending in a direction substantially parallel to the at least one basin wall;

wherein the rim is configured to be mounted abutting an underside of the horizontal countertop, wherein the rear face defines a planar surface that extends continuously between a right end portion and a left end portion, and wherein the apron is hollow and the cavity is substantially completely enclosed, the cavity extending between the right end portion and the left end portion.

16. The sink of claim 15, wherein the right end portion extends rightward of the rim and the left end portion extends leftward of the rim such that the apron is wider than the basin.

17. The sink of claim 15, wherein the ledge is substantially parallel to the rim and defines a ledge plane, the ledge plane offset by a first distance from a rim plane defined by the rim.

18. The sink of claim 15, wherein the ledge is oriented at a non-zero angle relative to a rim plane defined by the rim, the ledge configured to bias water into the basin when the basin is mounted abutting the underside of the horizontal countertop.

19. The sink of claim 18, wherein the non-zero angle is between approximately 25-50 degrees, inclusive.

* * * * *